US005470226A

United States Patent [19]

Pearl, II et al.

[11] Patent Number: 5,470,226

[45] Date of Patent: Nov. 28, 1995

[54] COMBUSTION DEVICE

[75] Inventors: David S. Pearl, II; Frank G. Smith, both of Fort Lauderdale, Fla.

[73] Assignee: Uniweld Products, Inc., Fort Lauderdale, Fla.

[21] Appl. No.: 267,657

[22] Filed: Jun. 29, 1994

[51] Int. Cl.[6] ..... F23Q 3/00

[52] U.S. Cl. ..... 431/255; 431/354; 431/254; 431/344; 431/264; 126/406

[58] Field of Search ..... 431/254, 255, 431/344, 345, 266, 264, 265, 354, 406; 126/25 B, 409

[56] References Cited

U.S. PATENT DOCUMENTS

| | | | |
|---|---|---|---|
| 4,013,395 | 3/1977 | Wormser | 431/9 |
| 4,348,172 | 9/1982 | Miller | 431/255 |
| 4,643,671 | 2/1987 | Yoshinaga | 431/255 |
| 4,732,559 | 3/1988 | Pearl, II et al. | 431/346 |
| 4,832,595 | 5/1989 | Eads | 431/255 X |
| 4,846,670 | 7/1989 | Pearl, II et al. | 431/346 |
| 4,919,111 | 4/1990 | Ohsawa | 126/25 B |
| 4,952,138 | 8/1990 | Ho | 431/344 X |
| 5,123,837 | 6/1992 | Farnham et al. | 431/258 |

FOREIGN PATENT DOCUMENTS

| | | | |
|---|---|---|---|
| 0272540 | 6/1988 | European Pat. Off. | 431/344 |
| 446162 | 9/1991 | European Pat. Off. | 431/255 |
| 0583941 | 2/1994 | European Pat. Off. | 431/264 |

*Primary Examiner*—Carl D. Price
*Attorney, Agent, or Firm*—Nields & Lemack

[57] ABSTRACT

A fuel combuster such as a torch tip, having means fixed ignition means and means for encapsulating the same. The combustion device comprises a metallic elongated tube having a forward section terminating in a front end, a middle section and a rearward section, the middle section communicating at its respective ends with the forward section and the rearward section. The rearward section is adapted, suitably at its rearward end, for connection to a source of combustible gas, and is suitably provided with axially positioned fuel jet means for injecting combustible gas into the tube and with apertures for intake of combustion supporting gas to be mixed with the combustible gas. A spring-loaded piezo crystal is affixed to the middle portion and is activated by grasping a cap assembly encapsulating the piezo crystal and applying a downward force thereto. The device can be ignited regardless of the orientation of the torch tip on the gas supply source.

10 Claims, 4 Drawing Sheets

COMBUSTION DEVICE

BACKGROUND OF THE INVENTION

The present invention relates to a fuel combuster, and more particularly to a torch tip.

Combustion chambers for burning premixed fuels with air have various applications, but generally require the mixing of the fuel with an oxygen source such as air, igniting the mixture, and burning the mixture. One such application is in self-contained portable torches, which use pressurized gas tanks as the fuel source. The fuel is mixed with ambient air and flows through a jet ejector or nozzle. Numerous attempts have been made to provide a torch tip which produces an even flame, which is easy to light, which will operate under any pressure, and which will not overheat. To that end, U.S. Pat. No. 4,732,559, assigned to the instant assignee and the disclosure of which is herein incorporated by reference, discloses a combustion device for generating a linear flame. The device includes means for combining a fuel gas and a combustion supporting gas, and means for stalling the combined fuel gas and combustion supporting gas when the combined gases are moving either at a low velocity or a high velocity.

Another fuel combuster is disclosed in U.S. Pat. No. 4,013,395. That device uses a vortex generator as a flame holder, which results in a swirling flame.

None of the prior art devices, however, is designed to provide easy, quick automatic lighting of the torch tip regardless of the position of the tip on the regulator.

It is therefore an object of the present invention to provide a combustion device so configured that it can be operated (e.g., ignited) from any position, regardless of how the tip is attached to the fuel source.

It is a further object of the present invention to provide a combustion device having automatically lighting means that is enclosed and thereby protected from outside contaminants.

These and other objects of the present invention will become apparent upon reference to the following description, drawings and claims.

SUMMARY OF THE INVENTION

The problems of the prior art have been overcome by the present invention, which provides a fuel combuster, and more specifically, a torch tip, having means therein for automatically igniting the tip. The torch tip is so configured that the automatic igniting means can be easily activated by the operator regardless of the position or angle of the device when coupled to a regulator.

In one embodiment of the present invention, the combustion device comprises a metallic elongated tube (e.g., a torch tip) having a forward section terminating in a front end, a middle section and a rearward section, the middle section communicating at its respective ends with the forward section and the rearward section. The rearward section is adapted, suitably at its rearward end, for connection to a source of combustible gas, and is suitably provided with axially positioned fuel jet means, including an orifice, for injecting combustible gas into the tube and with one or more apertures, preferably four or more in number, for intake of combustion supporting gas to be mixed with the combustible gas. The portion of the rearward section forward of the fuel jet means is provided with an axial passageway for transporting the combustible gas and the combustion supporting gas to the middle section. This axial passageway may be frustoconical shaped, so as to provide a Venturi effect. A piezo crystal is located near the axial passageway and when activated, creates a spark for ignition of the combustible gas. The axial passageway is encapsulated or covered by an outer shell, which also serves to cover the piezo crystal.

DETAILED DESCRIPTION OF THE PRESENT INVENTION

Figure 1:
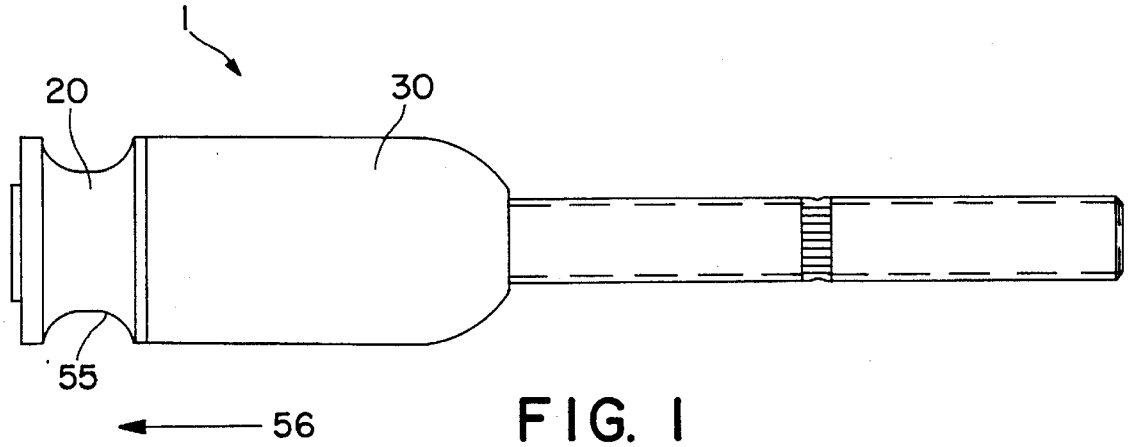
FIG. 1 is a side view of the combustion device of the present invention.
Figure 2:
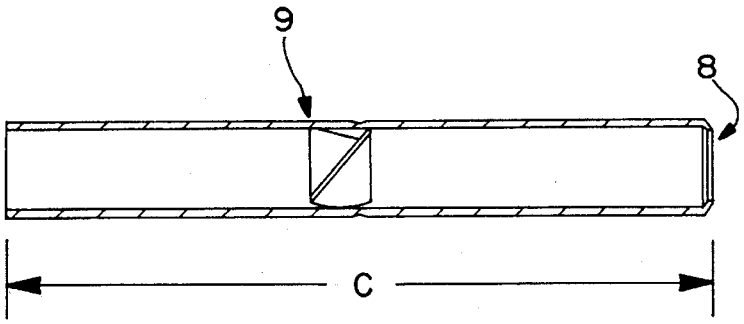
FIG. 2 is a cross-sectional view of the forward section of the torch tip of the present invention.
Figure 3:
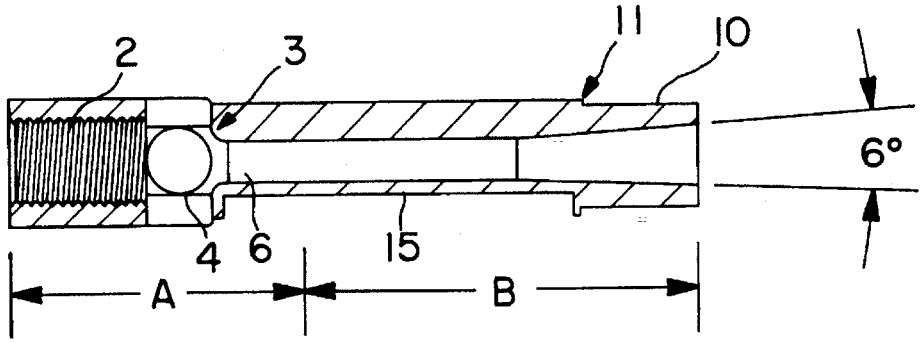
FIG. 3 is a cross-sectional view of the rearward and middle sections of the torch tip of the present invention.

Turning first to FIGS. 1–3, combustion device 1 is shown having a substantially tubular shape, and can be viewed as an elongated tube having three distinct sections A, B, C. Section A (FIG. 3) is the rearward section of torch tip 1 which is adapted at its rearward end to be connected to a source of fuel as by internally threaded means 2 or other suitable means, such as a quick connect mechanism. Section A includes a middle portion 3 of substantially rectangular cross-section which has openings 4 through which air is introduced into torch tip 1. Openings 4 are preferably four in number, each having a generally circular shape, but is should be understood that this is for illustrative purposes only; other shapes and or numbers of openings 4 may be suitable. An axially disposed jet nozzle (not shown) is included within the middle portion 3 of section A. The fuel gas passes from the source of fuel into and through the jet nozzle, which has a centrally formed orifice therein to allow for the fuel flow. The fuel gas ejected by the jet nozzle mixes with air which is introduced into tube 1 by openings 4. An axial passageway 6 is provided in the forward portion of the rearward section A for the passage of fuel gas and air into section B of the torch tip 1. Connecting means 2, middle portion 3, the jet nozzle and axial passageway 6 are preferably made of brass.

Section B is the middle section of torch tip 1 and is preferably made of brass, although stainless steel or other suitable material can be used. Its internal diameter is formed in a generally frustoconical shape, and provides a Venturi effect causing a large quantity of air to be sucked in by the cold fuel gas ejected by the jet nozzle and expanded and mixed with the fuel gas prior to burning. This creates a highly efficient flame with good characteristics. A portion 15 of the outer wall of sections B and A is recessed or cutaway so as to house the piezo crystal (not shown). A wire 81

(FIGS. 8 and 9) extends from the piezo crystal 80 along the recess 15 and into the bore of section C.

Section C (FIGS. 1 and 2) is the forward, generally cylindrical section of torch tip 1 and is preferably made of stainless steel. The internal diameter of section C is larger than the diameter of passageway 6 (FIG. 3). Outlet 8 constitutes the flame end of the torch tip 1. An impeller 9 can be positioned within this section to serve a gas-mixing function. Preferably the impeller 9 is secured in section C by crimping the outside of the cylindrical section and/or by forming knurls as shown in FIG. 1. Other suitable means for securing the impeller 9 can be used, such as a press fit. Cylindrical section C is of sufficient internal diameter so that a small portion thereof fits over section B and a portion of the wire (not shown) in electrical communication with the piezo crystal. Specifically, the forward end of section B includes a reduced diameter portion 10 (FIG. 3) defined by stop 11. Cylindrical section C is slidably received over portion 10 and against stop 11 so as to create a tight fit.

Figure 4:
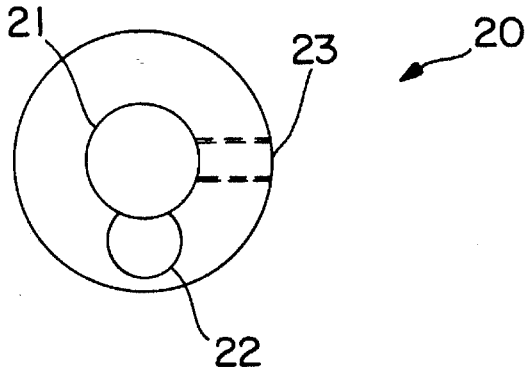
FIG. 4 is a top view of the nesting ring of the torch tip in accordance with the present invention.

Secured on middle portion 3 of section A is a nesting ring 20 (FIG. 4) preferably made of brass. The ring 20 includes a central aperture 21 of sufficient diameter to receive the cylindrical portion defined by passageway 6, but of smaller diameter than middle portion 3. The nesting ring 20 also may include an aperture 22 in which the piezo crystal may be secured. A side axial cutout 23 is provided for a set screw to secure nesting ring 20 in place on middle portion 3. (For purposes of clarity, FIG. 3 does not show the nesting ring 20.)

Figure 5:
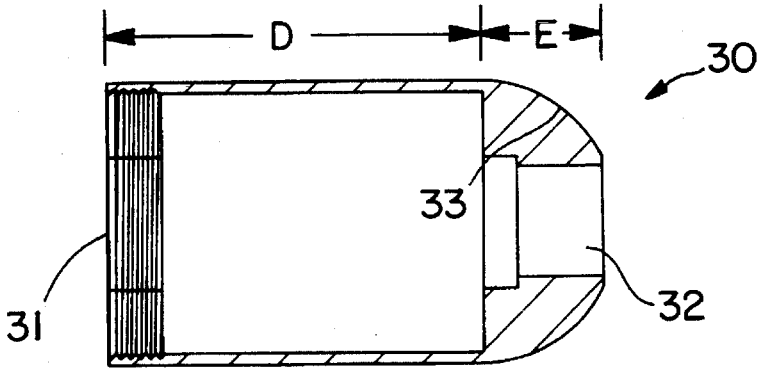
FIG. 5 is a cross-sectional view of the top portion of the Venturi mixer shell of the combustion device of the present invention.

Turning now to FIG. 5, there is shown Venturi mixer shell 30 of generally cylindrical shape and preferably made of aluminum. The mixer shell 30 is comprised of sections D and E as shown. The torch tip rearward end of section D includes internal threads 31 for receiving the mixer cap 50 as discussed below. The internal diameter of section D is slightly larger than the outside diameter of nesting ring 20, so that nesting ring 20 fits inside section D of the mixer shell 30 when the latter is placed in position.

Section E of mixer shell 30 includes an annular generally solid portion 33 and a stepped aperture 32. The smaller diameter portion of the stepped aperture 32 is suitably dimensioned to receive cylindrical section C of the torch tip, as best seen in FIG. 1. It is, however, small enough so that it creates a stop and does not receive the piezo crystal housed in portion 15 of the torch tip, the piezo crystal instead abutting against solid portion 33.

Figure 6:
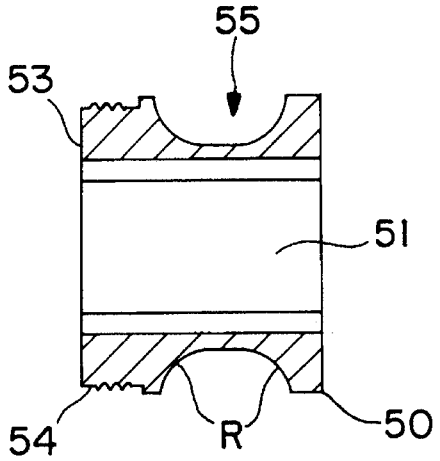
FIG. 6 is cross-sectional view of the Venturi mixer cap of the combustion device of the present invention.
Figure 7:
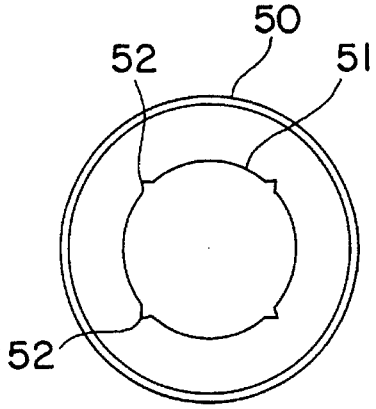
FIG. 7 is a top view of the Venturi mixer cap of FIG. 6.

With reference to FIGS. 6 and 7, there is shown the mixer cap 50 in accordance with the present invention. The mixer cap 50, preferably made of aluminum, includes a central bore 51 of generally circular cross-section. In the embodiment where middle portion 3 of section A of the torch tip has a square cross-section in the axial direction, V-shaped recesses 52, four in number, are preferably formed in central bore 51 to accommodate each corner of middle portion 3. This locks the torch tip in place by preventing rotation of section A of the middle portion 3. It will be readily understood by those skilled in the art that the particular shape of the central bore 51 and of any recesses 52 formed therein are not critical, as long as the central bore 51 is so configured that the mixer cap 50 can slidably receive middle portion 3 of the torch tip and lock it in place.

The upper torch tip forward end 53 of mixer cap 50 includes external threads 54 which receive the internal threads 31 of mixer shell 30, as best seen in FIG. 1. The upper torch tip forward end 53 abuts against nesting ring 20 when in the assembled state, and is locked in place by mating internal threads 31 with external threads 54.

Mixing cap 50 also includes an annular groove 55 suitably dimensioned to enable the operator to grasp the mixing cap 50 between two fingers, such as the index and middle fingers. A groove having a radius R of 0.218 inches has been found to be appropriate to accomplish this objective.

In the assembled condition as shown in FIG. 1, the mixer shell 30 fits over section B of the torch tip, with section C of the torch tip substantially extending therefrom. Mixer shell 30 is locked together with mixer cap 50 to form a single unit. A spring loaded piezo crystal is encapsulated by mixer shell 30 such that when the operator grasps the annular groove 55 of mixer cap 50 and creates force in the direction of arrow 56 in FIG. 1, the mixer shell 30 moves in the same direction, causing the solid portion 33 of the mixer shell 30 to contact the piezo crystal and force it in the direction of arrow 56, thereby activating the piezo crystal and generating a spark in the wire attached thereto, which in turn ignites the fuel supplied by the regulator to which the assembly is attached.

By so encapsulating the piezo crystal, the same is protected from solder, flux, water or other substances that are commonly used in brazing and soldering operations that may be deleterious to the piezo crystal. The mixer shell/mixer cap assembly also minimizes the possibility of spills being sucked into the air intakes. The symmetrical configuration of the design also enables the operator to activate the piezo crystal and light the torch regardless of the orientation of the torch tip 1 (FIG. 1) with respect to the regulator.

Figure 8A:
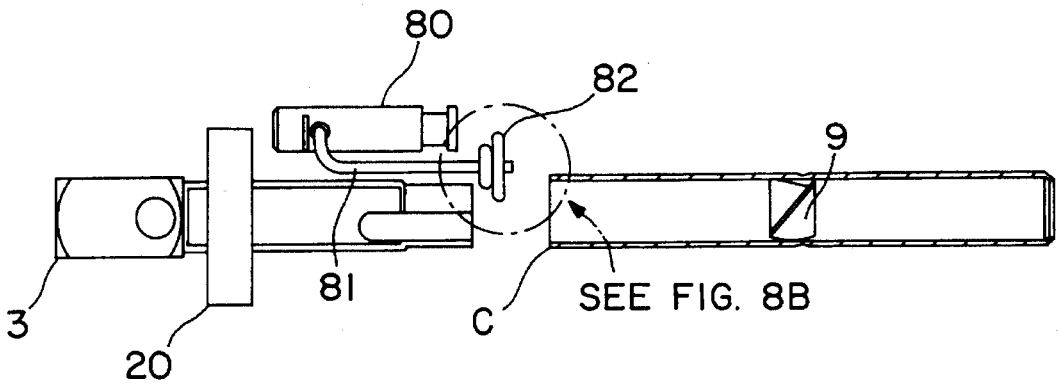
FIG. 8 is a cross-sectional view of a particularly preferred embodiment of the torch tip of the present invention.
Figure 8B:
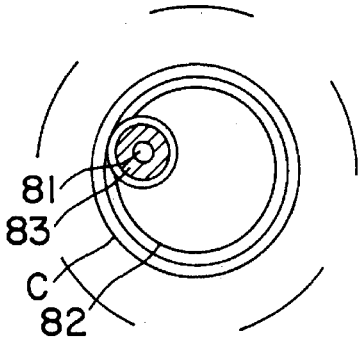
Figure 9:
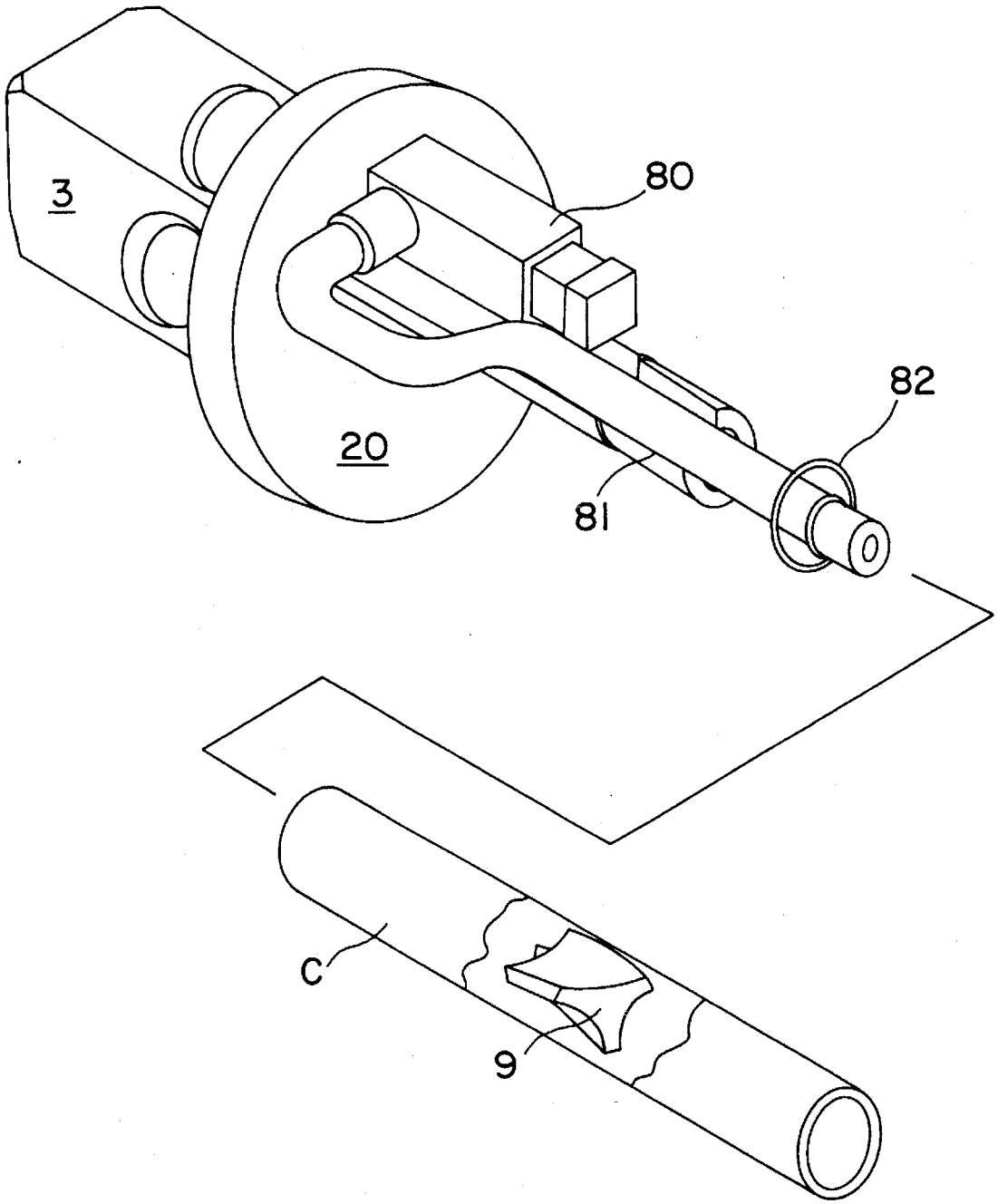
FIG. 9 is a perspective view, partially exploded, of a particularly preferred embodiment of the torch tip of the present invention.

Turning now to FIGS. 8 and 9, there is shown a preferred embodiment of the present invention, where the insulated wire 81 extending from the piezo crystal 80 is secured inside section C of the torch tip by means of a looped stainless steel wire 82. As shown in Detail A of FIG. 8, wherein 83 is the insulation on wire 81, a thin wire 82 is looped around the circumference of insulated wire 81 to a diameter slightly larger than the outside diameter of insulated wire 81 so as to grasp the insulated wire 81. An additional loop is made in wire 82, the additional loop having a diameter slightly smaller than the inner diameter of the tube of Section C. The loops are formed such that the position of the insulated wire 81 is acentric with respect to the larger loop. This arrangement maintains the insulated wire 81 in place inside Section C and minimizes any interference it may have with the flow of gas. The stainless steel wire 82 should be thin enough so as to itself avoid any interference with the flow of gas, yet thick enough to maintain insulated wire 81 in place. The insulated wire 81 may be so positioned deep enough inside Section C such that the electrical current created upon activation of the piezo crystal 80 travels through wire 81 and discharges from the uninsulated end thereof to the impeller 9.

What is claimed is:

1. A combustion device comprising:

combustible gas receiving means having a central axis, said combustible gas receiving means including a jet nozzle having an orifice for flow of said combustible gas;

combustion supporting gas receiving means;

mixing means along said central axis for combining said combustible gas and said combustion supporting gas;

torch tip means along said central axis and in gas-receiving communication with said mixing means;

ignition means for igniting said combustible gas coupled to said combustion device and generating a flame said torch tip means; and encapsulating means slidable along said central axis and comprising a mixer shell having a central bore for receiving said ignition means and said torch tip means, said encapsulating means encapsulating said ignition means and protecting the same from contamination.

2. The combustion device of claim 1, wherein said ignition means is affixed to said means for combining said combustible gas and said combustion supporting gas.

3. The combustion device of claim 2, wherein said ignition means comprises a spring-loaded piezo crystal.

4. The combustion device of claim 3, wherein said piezo crystal comprises an insulated wire for emitting a spark, said insulated wire being secured in said torch tip means so as to minimize interference with said flame.

5. The combustion device of claim 1, further comprising a mixer cap removably coupled to said encapsulating means, said mixer cap having a central bore for slidably receiving said combustion supporting gas receiving means, and having an annular groove.

6. A method of igniting a combustion device having an elongated tube comprising a flame emitting section and a gas receiving section coupled to said flame emitting section, and a nozzle in said gas receiving section for ejecting said gas, said elongated tube having gas ignition means affixed thereto, said gas ignition means being activated by compression, said method comprising:

encapsulating said ignition means with a cap assembly slidable along said elongated tube;

supplying a combustible gas to said gas receiving section; and exerting a force on said cap assembly causing said cap assembly to slide along said elongated tube and contact and compress said ignition means thereby activating the same.

7. The method of claim 6 wherein said cap assembly comprises a base portion having an annular groove.

8. The method of claim 6, wherein said cap assembly comprises a base portion having an annular groove, and wherein said force is exerted by grasping said annular groove.

9. A torch tip comprising:

a cylindrical forward section terminating in a front end;

a rearward section for receiving combustible gas and air including fuel jet means having an axial orifice and having an air induction system, the forward end of said rearward section having an axial cylindrical passageway for receiving the air and combustible gas mixture, said passageway having a diameter smaller than the internal diameter of said forward section;

a middle section, including a generally frustoconical portion, communicatively connecting said forward section to said cylindrical passageway and adapted to provide a Venturi effect;

ignition means associated with said cylindrical forward section; and a cap assembly slidable along said rearward section and comprising a base portion having an annular groove and a top portion having a central bore for receiving said rearward section, said cap assembly encapsulating said piezo crystal.

10. The torch tip of claim 7, wherein said ignition means comprises a spring-loaded piezo crystal affixed to said middle section, said piezo crystal including a wire in said cylindrical forward section.

* * * * *